US006029104A

United States Patent [19]

Kim

[11] Patent Number: 6,029,104

[45] Date of Patent: Feb. 22, 2000

[54] POSITION RECOGNITION APPARATUS FOR A PERSONAL RAPID TRANSIT CONTROL SYSTEM

[76] Inventor: In Ki Kim, 32-202, Hyosung Villa, #64 Chungdam-dong, Kangnam-gu, 135-100, Seoul, Rep. of Korea

[21] Appl. No.: 08/860,660

[22] PCT Filed: Nov. 7, 1996

[86] PCT No.: PCT/KR96/00197

§ 371 Date: Aug. 25, 1997

§ 102(e) Date: Aug. 25, 1997

[87] PCT Pub. No.: WO97/17244

PCT Pub. Date: May 15, 1997

[30] Foreign Application Priority Data

Nov. 8, 1995 [KR] Rep. of Korea ..... 95 40373

[51] Int. Cl.[7] ..... B61L 27/04

[52] U.S. Cl. ..... 701/20; 104/88.04; 701/24

[58] Field of Search ..... 701/19, 20, 22, 701/23, 24; 104/88.01, 88.02, 88.03, 88.04, 118, 119; 105/141, 144, 146, 147

[56] References Cited

U.S. PATENT DOCUMENTS

| | | | |
|---|---|---|---|
| 3,330,384 | 7/1967 | Bertin et al. . | |
| 3,646,613 | 2/1972 | Matsumoto et al. . | |
| 3,791,308 | 2/1974 | Hartz . | |
| 3,869,990 | 3/1975 | Bertling . | |
| 3,874,299 | 4/1975 | Silva et al. . | |
| 3,882,788 | 5/1975 | Simon et al. . | |
| 3,882,790 | 5/1975 | Winkle et al. . | |
| 3,901,160 | 8/1975 | Auer et al. . | |
| 3,931,767 | 1/1976 | Karch . | |
| 4,061,089 | 12/1977 | Sawyer . | |
| 4,665,830 | 5/1987 | Anderson et al. . | |
| 4,671,185 | 6/1987 | Anderson et al. . | |
| 4,690,064 | 9/1987 | Owen | 104/119 |
| 4,766,547 | 8/1988 | Modery et al. . | |
| 4,791,871 | 12/1988 | Mowll | 104/88.02 |
| 4,819,564 | 4/1989 | Brandis et al. . | |
| 4,987,834 | 1/1991 | Peck, Jr. et al. . | |

(List continued on next page.)

FOREIGN PATENT DOCUMENTS

| | | |
|---|---|---|
| 242177 | 10/1987 | European Pat. Off. . |
| 2150245 | 4/1973 | Germany . |
| 2420245 | 10/1975 | Germany . |

OTHER PUBLICATIONS

*Physics*, "Faraday's Law of Induction," David Halliday and Robert Resnick, pp. 770–774, 1960.

*Primary Examiner*—William A. Cuchlinski, Jr.
*Assistant Examiner*—Edward Pipala
*Attorney, Agent, or Firm*—Stevens, Davis, Miller & Mosher, L.L.P.

[57] ABSTRACT

A position recognition apparatus for personal rapid transit. The personal rapid transit system comprises a chassis (40) for moving at the inside of a guideway (10) and a chamber for passengers being mounted on the chassis (40) at the outside of the guideway (10). The chassis (40) is provided with guidance wheels (41 and 42), electric linear motors (44*a* and 44*b*), a switching device, brakes, a control apparatus (70) and electric power supply devices. Bar code scanners (60*a* and 60*b*) are installed at both sides of the chassis (40) in the inside of the guideway (10). Bar codes include figures and letters indicating sections and positions at a certain interval on the guideway (10), and are printed on bar code members (50*a* and 50*b*) having a predetermined width which is made of plastics. The plastic bar code members (50*a* and 50*b*) on which the same bar codes are printed are attached to both sides of the guideway (10). The scanners (60*a* and 60*b*) recognize positions and speed of the vehicles (80) from bar codes which are arranged opposite to the scanners (60*a* and 60*b*) fixed at the chassis (40) of the vehicles (80), and transmit the data to a computer which is installed adjacent to the scanners (60*a* and 60*b*) for controlling the vehicles (80). The computer controls the driving motors of the vehicles (80) to thereby provide effects of performing accurate interval maintenance and preventing in advance rear-end collision and collision between vehicles under the control of interval and speed.

14 Claims, 5 Drawing Sheets

U.S. PATENT DOCUMENTS 5,033,394 7/1991 Summa .
5,108,052 4/1992 Malewicki et al. .
5,138,952 8/1992 Low .
5,797,330 8/1998 Li ..... 701/19

POSITION RECOGNITION APPARATUS FOR A PERSONAL RAPID TRANSIT CONTROL SYSTEM

TECHNICAL FIELD

The present invention relates to a position recognition apparatus for a Personal Rapid Transit (PRT) which is a public transportation system in which small vehicles operate automatically over a network of elevated guideways to provide non-stop origin-to-destination transport service to individuals or small groups. In order to obtain enough capacity on the lines the vehicles must operate at short headways of 0.5 seconds or more.

More particularly the control system for such short headway operation requires highly accurate determination of the location and speed of each vehicle in the system at all times so that each vehicle can maintain a certain interval from other vehicles, and avoid collision during merging and other manoeuvers.

The PRT vehicles employ a position recognition apparatus which is related to the invention "An Electromagnetic Switch System For Personal Rapid Transit" under Korean patent application 94-14033 filed by the same applicant.

BACKGROUND ART

Many types of position recognition apparatus are used in fixed guideway transportation systems. However, these transportation systems operate at substantial time intervals between vehicles or trains and the position recognition systems are not required to be particularly accurate.

Conventional fixed guideway transit systems such as railways, subways, light rail systems and some automated guideway transit systems use a track circuit system for locating the position of trains or vehicles. The track is divided into sections called blocks which are insulated from each other. Each block varies in length according to the design operating speed and to the length of the typical trains. Typical block lengths will be about 2000 m. Subway systems tend to be slower and have shorter block lengths of 300 m to 1000 m. Once the train or vehicle enters the track section this can be detected by the wayside control equipment and the train presence is then transmitted to the central control computer for processing into a train control signal. In this type of system the trains are operating at 60 second to 300 second headways so the relative inaccuracy of the position location system (+/− One Block Length) is not too important.

High speed trains and short headway subways require greater accuracy, therefore these systems use a moving block system which also allows continuous steel rails to be used. The track circuit can be arranged as an inductive loop and the locomotive or other wagons can be fitted with an induction device which activates the track circuit. This approach eliminates the inaccuracy caused by the train length which is often over 400 m.

Another position location device uses the Global Positioning System (GPS) which uses geostationary satellite transmissions to determine the vehicle's location within 25 m or so. The accuracy of this system represents a major advance over traditional track circuit or moving block systems, but it can not be used in subway tunnels, inside some shielded buildings and in some geographical locations.

None of these systems is suitable for the SKYCAR PRT system since the degree of accuracy is inadequate by orders of magnitude varying from 2 to 4 ie. 100 to 10,000 times greater than the accuracy required for PRT. By the same logic none of the previous or existing transportation systems have used bar coding in this way to form a train or vehicle control system. This is because they never required the degree of accuracy in position location.

Bar Codes and Laser Scanners are also widely used in the identification of vehicles or materials being transported on a fixed guideway. For example bar codes are used in railway freight wagon location. The bar code is attached to the wagon and a trackside reader transmits the wagon's identity to a control center. Bar codes are also used in airport baggage systems to track baggage carts in automated baggage systems. Barcodes are also used on packages carried by conveyor belts with the bar code reader located stationary beside the belt. Barcode readers are also stationed beside industrial assembly lines to monitor and control bar coded parts flow.

No industrial or transportation system to our knowledge mounts the bar code scanner on the moving vehicle and arranges the bar code in a sequential strip in the guideway. This invention is the basis of this claim.

DISCLOSURE OF THE INVENTION

The typical PRT system will travel at speeds of 45 km/hr (12.5 m/sec) to 60 km/hr (16.67 m/sec). The location accuracy required for control of vehicles is about 100 mm, therefore the location of each vehicle must be fixed every 6 to 8 milliseconds which is equivalent to 100 mm of travel distance.

Each vehicle must fix its position every 6 to 8 milliseconds and transmit its identity and position information to the guideway zone controller and to the following vehicles on the guideway and to vehicles approaching on merging lines. Each vehicle must be able to receive data concerning the identity, position and speed of the vehicle in front and the same type of data from vehicles approaching on merging lines.

This invention describes a vehicle position locating system which provides the necessary degree of accuracy and which is essentially foolproof yet which is economical and reliable in use. It involves a new way of applying laser bar-code reading technology to transportation control systems.

A bar coded strip is attached to each side of the interior of the SKYCAR PRT guideway 10. Uniquely sequenced numbers are inscribed on the strip at 100 mm intervals. Each vehicle 80 consisting of a chassis 40 and a body 30 is equipped with two laser bar code scanners 60*a* & 60*b* which are positioned on either side of the vehicle chassis 40 to read the sequence of bar codes. The bar code strip numbers 50*a* & 50*b* on either side of the guideway are identical at each position. This allows the system to operate with redundancy. The bar code scanners 60*a* & 60*b* will be failure monitored so that in the event a scanner 60 fails the vehicle 80 will be programmed to return to the maintenance depot. The chance of the second scanner 60 failing in the short time this requires is very small indeed since the probability will be MTBF×MTBF where Mean Time Between Failures (MTBF) may be 10,000 hours. This would give a vehicle position recognition MTBF of 100,000,000 hours which is equivalent to 27,000 years of operation, and failure monitoring will extend this further.

Each bar code reading is transformed to digital format and communicated to the vehicle's on-board computers 72 where the time interval between the present position reading and the previous position reading can be measured. A simple calculation gives the vehicle speed. If the vehicle 80 is accelerating or decelerating a simple calculation will also give the acceleration or deceleration rate. If the same position is recorded by successive readings the vehicle 80 is stationary.

The vehicle identity, position, speed and acceleration/deceleration status can be transmitted to the guideway communication ducts 21*a* & 21*b* within a microsecond during which the vehicle 80 will only have travelled 0.0125 mm. This data is transmitted by the guideway communications ducts 21*a* & 21*b* to the guideway zone controller (Not shown) and to other adjacent vehicles (Not shown).

The advantages of this system are that it is economical to manufacture and operate, reliable and provides a unique position reading with no chance of errors or ambiguities. The PRT vehicle 80 consists of a chassis 40 which runs inside the guideway 10, and a passenger carrying body 30 which is mounted on the chassis 40 outside the guideway 10. The chassis 40 consists of a frame onto which are mounted the support wheels 42 and guidance wheels 41, the linear propulsion motors 44*a* & 44*b*, switch mechanisms 46, brakes (Not Shown), vehicle control system 70, power conditioning equipment (Not shown) and other auxiliary equipment (Not shown).

The bar code scanners 60*a* & 60*b* are mounted at the sides of the chassis 40 opposite the control and communications ducts 21*a* & 21*b* which are attached to each side of the guideway 10 interior.

The scanners 60*a* & 60*b* are mounted on each side of the chassis 40 on the same lateral axis as the lateral guidance wheels 41.

This feature eliminates any variation in reading distance which would occur when the vehicle 80 passes through a small radius curve in the guideway 10.

The bar codes are engraved on a plastic strip 50 about 100 mm wide with a sequential number every 100 mm. The bar coded strips 50*a* & 50*b* are attached by cement to the control and communications ducts 21*a* & 21*b* which are located inside the guideway 10 on either side.

Each of the bar code scanners 60*a* & 60*b* is mounted on a softly sprung suspension 63, 64 & 66 which is attached to the chassis 40. This isolates the bar code scanners 60*a* & 60*b* from vibration which could damage the mechanisms. Vibration sources consist of the dynamic vibrations of the guideway 10 and the vehicle 80 suspension vibration.

The vehicle on-board control computers 72*a* & 72*b* are attached to the chassis 40 adjacent to the bar code scanners 60*a* & 60*b*. The control computers 72 are duplicated and failure monitored. They are designed to operate redundantly in the event of failure of one computer.

The Guideway Communications Unit(GCU) (Not shown) consisting of transmitters and receivers for vehicle control, communications and position data transmission are mounted on each side of the chassis 40 opposite the control and communications ducts 21*a* & 21*b*.

In this design the bar-code position location system is not affected by radio, microwave, infrared or electromagnetic transmissions or emissions from the vehicle's 80 onboard equipment or by other sources external to the guideway 10.

The interior of the SKYCAR PRT guideway 10 is protected from weather and debris by a cover 13 and a pair of flexible sealing strips 18 which close the slot 14 in the top of the guideway through which the vehicle's body support fin 45 passes. This arrangement keeps the bar-codes 50*a* & 50*b* clean and clear of debris, dust, rain and other materials which might otherwise obscure the bar-code 50*a* & 50*b* or impair the laser bar code scanner 60*a* & 60*b*.

The SKYCAR PRT system is equipped with a guideway monitoring vehicle (Not shown) and a guideway maintenance vehicle (Not shown). The guideway monitoring vehicle, among its other functions, will read the bar codes for signs of dirt or damage, on a regular basis and at least once a day. This vehicle will have a cleaner arm (Not shown) which will be able to wipe the barcodes 50*a* & 50*b* clean of any dirt which might accumulate in small areas during the day. The guideway maintenance vehicle will traverse the entire PRT network at off-peak hours and when the system is closed down for maintenance. This vehicle will be equipped to clean the entire bar code system on a periodic basis.

The bar-codes 50*a* & 50*b* will be replaced every few years according to the degree of deterioration experienced. There will be no wear on the bar code surface except for the periodic cleaning.

The plastic strip will be engraved so the bar-code 50*a* & 50*b* should resist many years of gentle cleaning. A bar-code 50*a* & 50*b* strip life expectancy of at least five years is expected. The bar codes 50*a* & 50*b* can be removed and replaced in segments during routine periodic maintenance periods.

BEST MODE FOR CARRYING OUT THE INVENTION

The preferred embodiments of a position recognition apparatus for PRT vehicles in accordance with the present invention will be described in detail with reference to the accompanying drawings.

The Personal Rapid Transit system will be briefly described in a preferred embodiment since the design of the system as applied to the present invention was described in Korean patent application No.94-14033 filed by the same applicant.

The Personal Rapid Transit system (hereinafter referred to as PRT) is a public transportation system in which small vehicles 80 operate automatically over a network of mostly elevated guideways 10 to provide non-stop origin-to-destination transport service to individuals or small groups travelling between off-line stations. In order to obtain enough capacity on the guideway 10 the vehicles 80 must operate at short headways (Where headway is defined as the time interval elapsing between successive vehicles passing a given point) of 0.5 seconds or more. This type of operation requires highly accurate control of the vehicle's 80 location and speed in order to carry out the various operations required in merging two lines of vehicular traffic, entering and leaving off-line stations and other manoeuvers.

To achieve this accuracy of location the position recognition apparatus defined below has been invented. The present embodiment of this apparatus is unique to the PRT system as currently configured for reasons which will be explained in detail below.

Figure 1:
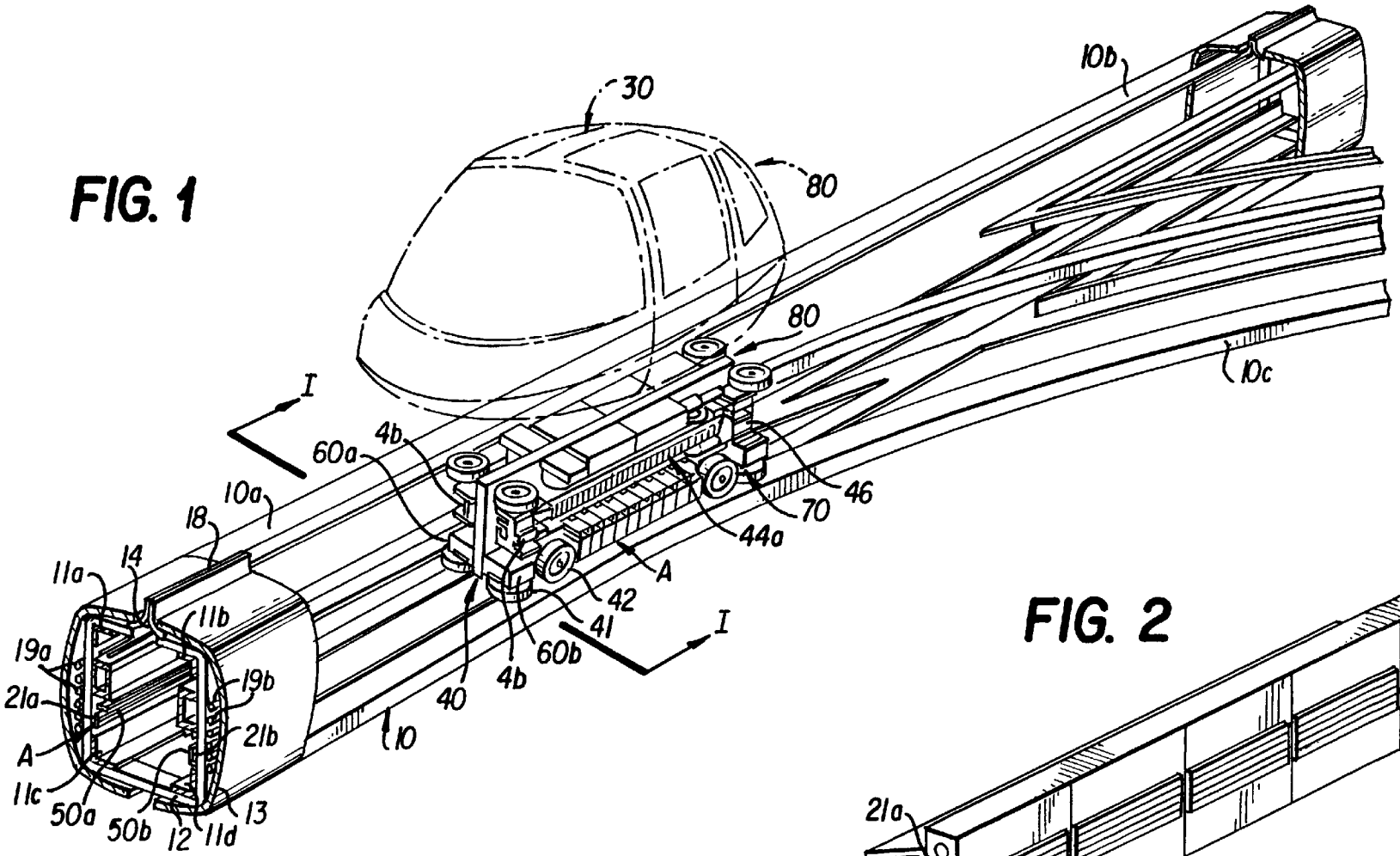
FIG. 1 is a cut-away perspective view showing part of the PRT system including a vehicle 80 merging through a switch from guideway paths 10*b* or 10*c* to guideway path 10*a* on the guideway. The drawing shows a position recognition apparatus mounted on the vehicle 80 and the bar-codes 50 mounted on the control ducts 21, in accordance with the present invention.
Figure 2:
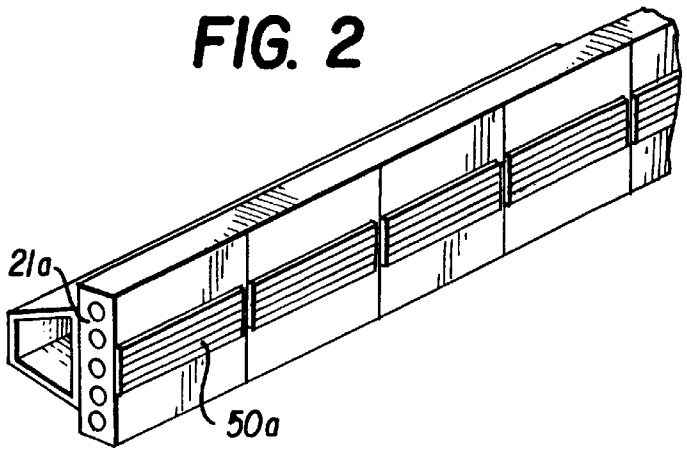
FIG. 2 is a perspective view showing only part "A" of FIG. 1, the control duct 21*a* with the bar-code 50*a* attached.
Figure 3:
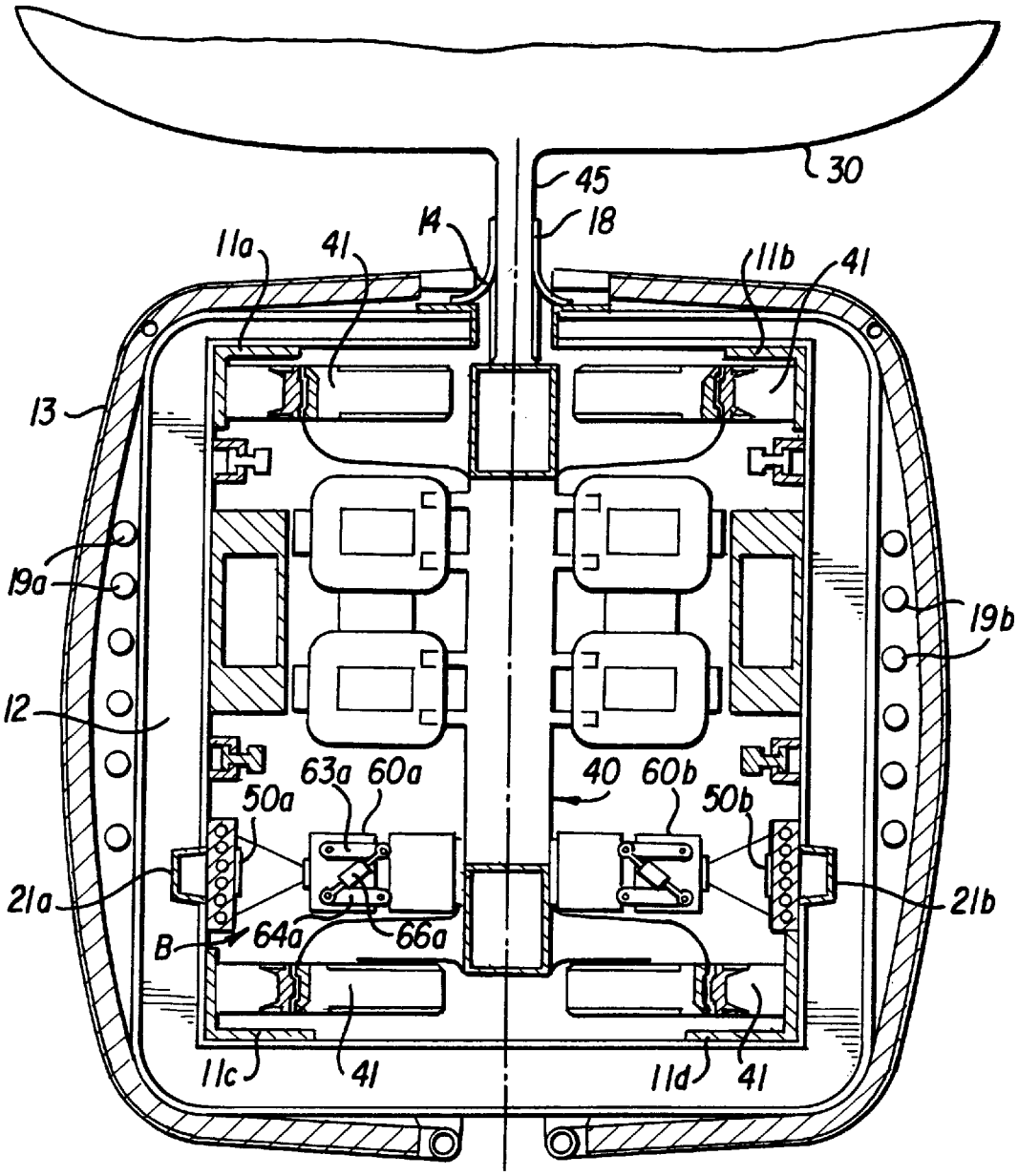
FIG. 3 is an enlarged cross sectional view of the guideway 10 and vehicle chassis 40 taken at cross section I—I of FIG. 1.

FIG. 1 is a cut-away perspective view showing part of the personal rapid transit system on which a position recognition apparatus is mounted in accordance with the present invention, FIG. 2 is an enlarged perspective view showing only part "A" of FIG. 1, and FIG. 3 is an enlarged sectional view taken along a line I—I of FIG. 1.

The personal rapid transit system will be briefly described in a preferred embodiment since construction of the personal rapid transit system applied to the present invention was in detail described in Korean patent application no. 94-14033 filed by the same applicant. The personal rapid transit system comprises a vehicle guideway 10 having a steel box structure which is aerial-installed in a network fashion in the downtown area, and a small vehicle 80 which can travel along the vehicle guideway 10 at a high speed. The guideway 10 consists of a main path 10*a* and diverging paths 10*b* and 10*c* diverged from the main path 10*a*, at the top center of which a guidance slot 14 is formed for travelling of the small vehicle 80.

A main body in the box frame of the guideway 10 is sealed with a cover 13, and the cover 13 is installed over the whole excluding only the guidance slot 14 of the guideway 10, and a flexible cover strip 18 is attached to the guidance slot 14 in order to prevent the entry of outside substances therethrough. The cover 14 is insulated to eliminate noise, electronic wave, microwave and electromagnetic interference produced when the small vehicle 80 travels along the guideway 10.

Guidance rails 11*a*~11*d*, which are arranged at four edges of a lateral frame 12 being almost in □ shape, are integrally fixed along the guideway 10 to play a role of guidance rail for the small vehicle 80. Between the cover 13 and the lateral frame 12 of the guideway 10, communication cables 19*a* and electric power supply cables 19*b* are arranged. At the inside of the lateral frame 12 in the guideway 10, communication ducts 21*a* and 21*b* are equipped along the guideway 10. The small vehicle 80 rapidly travels along the slot 14 of the guideway 10, the running of which is performed by a linear motor 44*a* and guidance wheels 41 and 42. The linear motor 44*a* which is controlled within a control apparatus 70, makes a vehicle chassis 40 move backward or stop. Detailed structure with regard to the control apparatus 70 will be described hereinafter.

Figure 5A:
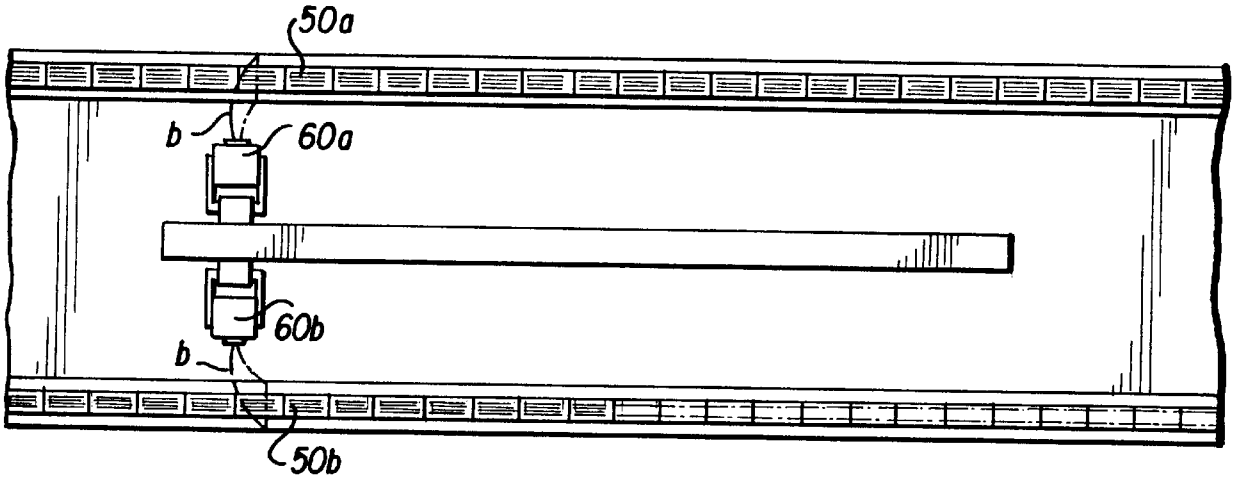
FIG. 5A and FIG. 5B are views showing two alternative directions for the bar-code striping 50 to be applied to the control ducts 21 which are attached to each side of the guideway 10. The striping may be applied vertically or horizontally to achieve the most efficient operation of the position recognition apparatus which is installed in the PRT in accordance with the present invention.
Figure 5B:
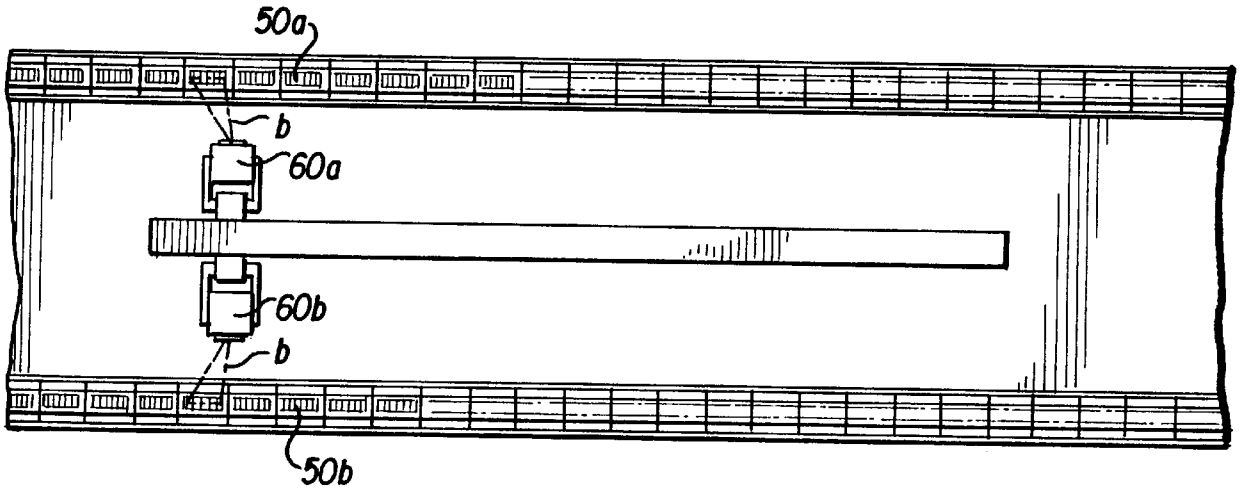

The personal rapid transit system comprises a position recognition apparatus for controlling the position and speed of the vehicles 80 of the guideway 10. The position recognition apparatus of the vehicles 80 consists band-shaped bar code members 50*a* and 50*b* on which bar codes are printed, and scanners 60*a* and 60*b*. The bar code members 50*a* and 50*b* are firmly attached to the surface of the communication ducts 21*a* and 21*b* installed in the guideway 10. To the bar code members 50*a* and 50*b*, as shown in FIG. 5, bar codes can be attached in the horizontal direction or the vertical direction. It is preferable that bar position directions of the bar code members 50*a* and 50*b* can be modified according to the direction of laser beams from the scanners 60*a* and 60*b*. As shown in FIG. 5A, when the laser beams b of the scanners 60*a* and 60*b* are emitted into vertical direction, the bar of the bar code members 50*a* and 50*b* is attached in the horizontal direction being orthogonal to the laser beams b. On the contrary, as shown in FIG. 5B, when the laser beams b of the scanners 60*a* and 60*b* are emitted into the horizontal direction, the bar of the bar code members 50*a* and 50*b* is attached in the vertical direction being orthogonal to the laser beams b. The bar code members 50*a* and 50*b* is at the range of 10 cm in width, at which figure positions indicating an interval of 10 cm and sections of the guideway 10 are set and printed The scanners 60*a* and 60*b* disposed opposite to the bar code members 50*a* and 50*b* read respective sections and figure positions set on the bar code members 50*a* and 50*b*, and transmits the read data to a control apparatus of computer described hereinafter.

The scanners 60*a* and 60*b*, disposed opposite to the bar code members 50*a* and 50*b*, are attached to both sides of the chassis 40, respectively. As shown in FIG. 3, it is preferable that the scanners 60*a* and 60*b* are located at the center of the bar code members 50*a* and 50*b* so as to provide easy position recognition from the bar code members 50*a* and 50*b*. The scanners 60*a* and 60*b* are firmly supported by CPU boards 72*a* and 72*b* in the control apparatus 70 installed at the chassis 40 of the vehicle 80. This will be in detail described in FIG. 4.

Figure 4A:
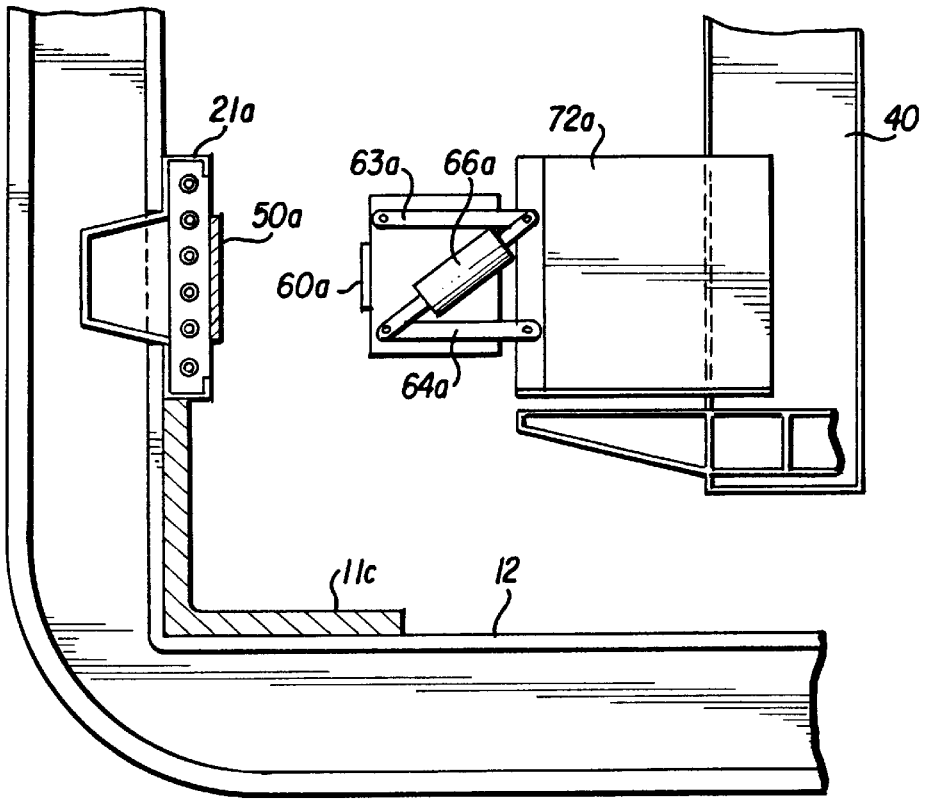
FIG. 4A is an enlarged side elevation view illustrating part "B" of FIG. 3, the bar-code scanner 60*a* mounted on the vehicle chassis 40.
Figure 4B:
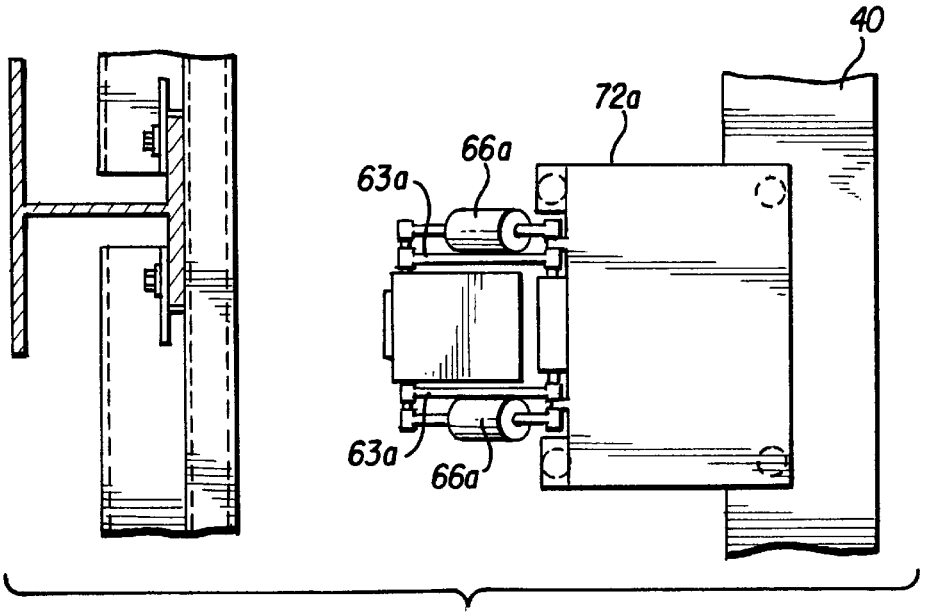
FIG. 4B is a plan view of part "B" as shown in FIG. 4A, the bar-code scanner 60*a* mounted on the vehicle chassis 40.

FIG. 4A is an enlarged view illustrating part "B" of FIG. 3, and FIG. 4B is a plane view of FIG. 4A. The scanner 60*a* is supported by each pair of support linkages 63*a* and 64*a* arranged at the right and left thereof, which are capable of moving upward and downward on the CPU board 72*a* mounted at the chassis 40. The scanner 60*a* also includes spring dampers 66*a* at both sides thereof, in order to absorb shock of vibration from the vertical direction of the vehicle 80. Particularly, the spring dampers 66*a* which are installed in the diagonal direction, reduce vibration of the scanner 60*a* from that of the CPU board 72*a*. Accordingly, the scanner 60*a* uniformly maintains the height of with regard to bar codes 50*a* attached to the inside of the guideway 10, thereby mal-operation of the scanner 60*a* being minimized.

In this embodiment, only suspending structure attached at one side of the scanner 60*a* has been described since the suspending structure of other scanners attached the other side is also same.

Figure 6:
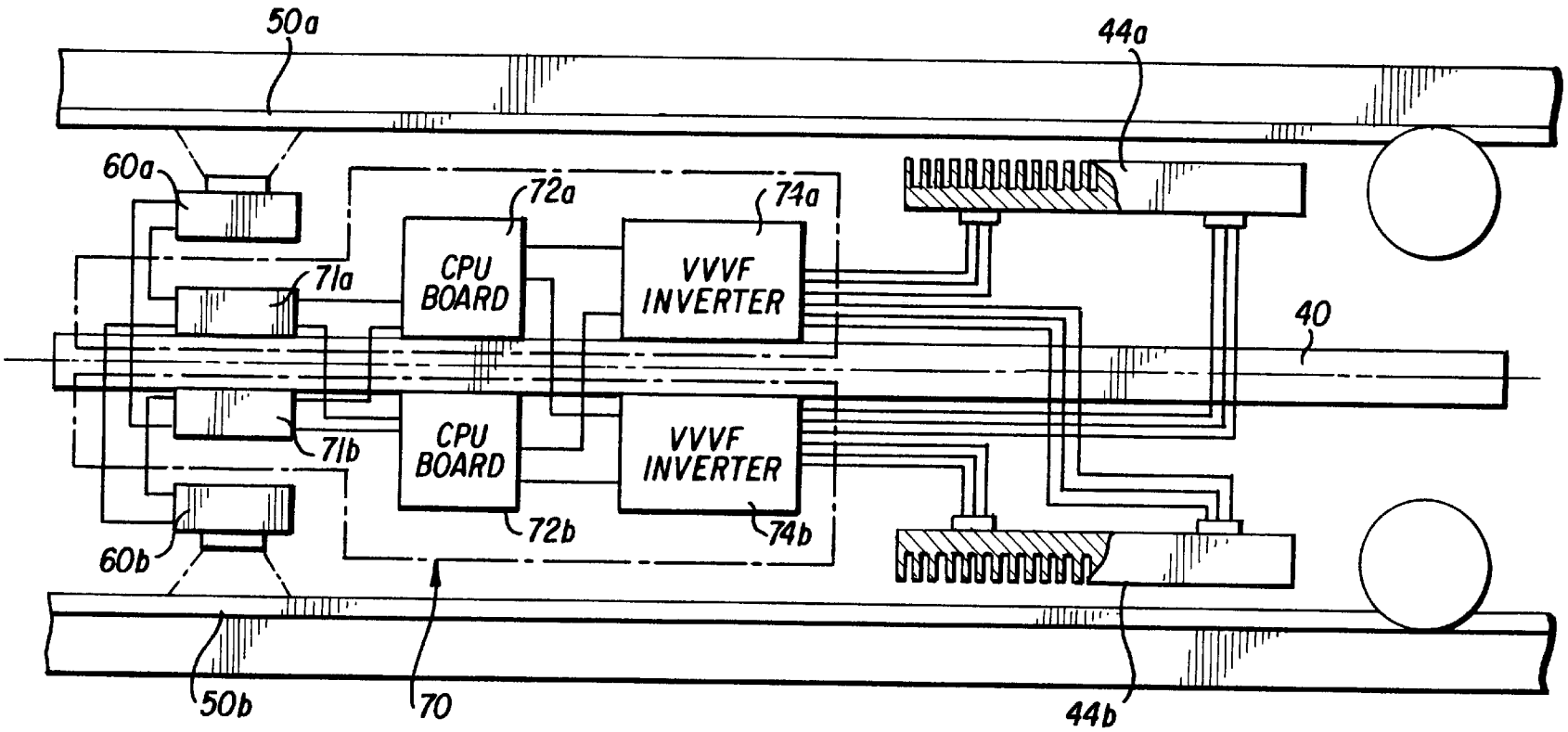
FIG. 6 shows a simplified schematic of the complete control apparatus 70 for the PRT vehicles. The position recognition system is one of the primary interfaces between the vehicle and the guideway which is then input to the PRT vehicle control system in accordance with the present invention.

FIG. 6 shows schematically a control apparatus of the vehicle for operation of systems and position recognition, which is installed within the position recognition apparatus for the personal rapid transit in accordance with the present invention. The control apparatus 70 includes network boards 71*a* and 71*b* which are electrically connected to the scanners 60*a* and 60*b*, respectively, CPU boards 72*a* and 72*b* coupled electrically with the network boards 71*a* and 71*b*, and inverters 74*a* and 74*b* coupled to the CPU boards 72*a* and 72*b*, all of which are coupled with linear motors 44*a* and 44*b* which deliver propulsion force to the vehicle.

The network boards 71*a* and 71*b* play a role of informing positions and speed of the vehicle recognized from the scanners 60*a* and 60*b* to other vehicles, as well as delivering data on the direction and speed of vehicles applied from a central control room to the CPU boards 72*a* and 72*b*, which have wire or radio networks.

One located at the front of the chassis 40 among the scanners 60*a* and 60*b* and an example connected with the control apparatus 70 are described with reference to the drawings. Illustrations concerning the other scanner placed at the rear of the chassis 40 will be omitted as the latter is the same as the former.

The reason that two CPU boards and scanners are installed at the both of the chassis 40, respectively, is to perform position recognition and control function when one of both has any drawbacks.

Functions and effects of the position recognition apparatus for accordance with the present invention as constructed above will be described with reference to FIG. 1 and FIG. 6.

First, the chassis 40 of the vehicle 80 automatically runs at a high speed along the guidance rails 11*a*~11*d* of the guideway 10 with guidance wheels 41 and 42, by propulsion force generated from the linear motors 44*a* and 44*b*. During travelling of the vehicle 39 along the guideway, the scanners 60*a* and 60*b* disposed at the chassis 40 emit laser beams b necessary to reading out sections and directions of the guideway 10 set on the bar code members 50*a* and 50*b*, toward the bar code members 50*a* and 50*b* being on the opposite to the scanners 60*a* and 60*b*. A current position sensed by the laser beams b from the scanners 60*a* and 60*b* or similar data applied from other vehicles are transmitted to the CPU boards 72*a* and 72*b* installed in the computer (Not shown). Then, the computers of the CPU boards 72*a* ad 72*b* process the collected data, and control to accelerate or decelerate the propulsion force of the linear motors 44*a* and 44*b* with the processed data via the inverters 74 and 74*b*. Since specific description that the control apparatus 70 controls the linear motors 44*a* and 44*b* of the vehicle 80 with data detected by the scanners 60*a* and 60*b*, can be made into several modifications, the present embodiment does not describe only any one specific example.

Elements of the present invention will be in detail described hereinafter.

PRT Guideway Elements

The PRT guideway structure consists of a steel box frame 10 which has four longitudinal guidance and support members 11*a*,11*b*,11*c* & 11*d*. These longitudinal members 11 are braced by diagonal members (Not shown) and stiffened torsionally by lateral frames 12. The vehicle chassis 40 runs inside the box frame 10. The box frame 10 has a slot 14 at the top through which a narrow support fin 45 protrudes to support the vehicle body 30.

The communications for the control system are carried within ducts 21*a* & 21*b* located on either side of the guideway. The bar-codes for position recognition 50*a* & 50*b* are mounted on the interior faces of the communications ducts 21*a* &21*b*. The bar codes 50*a* & 50*b* are engraved on plastic tape with slightly variable spacing so that through curved guideway sections the scanners 60*a* & 60*b* on each side of the vehicle will read the same location. The guideway structure is completely enclosed by a polycarbonate cover 13 which is fitted with sound insulating material and shielded against the transmission of microwave and electromagnetic radiation from external and internal sources. At the top of the guideway covers a flexible sealing strip 18 is fitted to each side of the slot to exclude dust, debris, snow and rain. The sealing strip 18 is parted when the vehicle body support fin 45 passes along the guideway and closes behind it. In this way the guideway 10 interior is protected from the entry of dirt and dust which might affect the bar-code scanners 60*a* & 60*b*. The electrical power cables 19*a* and the fiber-optic communications cables 19*b* are located between the guideway cover 13 and the lateral guideway frames 12. The fiber-optic communication cables 19*b* carry all communications from the zone controllers (Not shown) to the Central Control (Not shown). The fiber optic cables 19*b* are not affected by electromagnetic interference or microwave transmissions.

PRT Vehicle Chassis Elements

The bar-coded strips 50 which are attached to the guideway 10 must have a unique position identity which is programmed into the vehicle control system 70 logic. This enables any vehicle 80 to identify its position within microseconds under any operating conditions.

Since the vehicles 80 will be travelling at velocities of 12.50 m/sec to 16.67 m/sec the bar code scanners 60 will have to have very high scanning speed and a resistance to vibration induced in the guideway 10 and in the vehicles 80.

PRT Vehicle Guidance, Propulsion and Switching

The PRT vehicles are propelled and braked by linear motors 44*a* & 44*b* mounted on each side of the vehicle chassis 40. The vehicles are guided by horizontal guidance wheels 41 mounted at the top and bottom of the chassis on each side. The vehicle is supported by vertical running wheels 42 at each end of the chassis. The vehicles are switched from the left guideway path 10*b* or from the right guideway path 10*c* to the main guideway path 10*a* by application of electromagnetic switches (Not shown) mounted to the chassis 40. Activation of the left side switch electromagnets (Not shown) force the vehicle to follow the left side guideway 10 wall and vice versa for switching to the right.

PRT Vehicle Control System

The PRT vehicles 80 are operated by an asynchronous control system in which each vehicle manoeuvers independently on the guideway to reach its destination station. The PRT control system consists of four major components:

(1) Control Center responsible for overall management of the vehicle fleet and monitoring of stations and guideway links.

(2) Station Controllers responsible for the movement of passengers and vehicles within the station area.

(3) Guideway Zone Controllers responsible for controlling the movements of individual vehicles 80 within any given guideway 10 section.

(4) Vehicle Control 70 on board each vehicle 80 responsible for controlling the linear motor 44 thrust magnitude and direction, also responsible for switching according to instructions received from the guideway zone controllers.

Each vehicle determines its position and speed by means of the position recognition apparatus which uses laser scanners 60 to read the position on the guideway from the bar-code 50. This data is transmitted from the vehicle 80 to the local Guideway Zone Controller (Not shown) via the Guideway Communications Unit (Not shown) and the guideway communications duct 21. The Guideway Zone Controller calculates the manoeuvers required for the vehicle to follow the preceding vehicle at a safe distance or to manoeuver so that other vehicles 80 can merge safely into the line. The commands are transmitted to the vehicle 80 via the Guideway Communications Unit whence they are relayed to the vehicle control system 70. The vehicle control 70 system consists of redundant computation processing units (CPU) 72*a* & 72*b* which will then issue the necessary commands to the vehicle's linear motor controllers 74*a* & 74*b* which are redundant Variable Voltage Variable Frequency (VVVF) inverters or to the electromagnetic switches (Not shown).

Bar-Code Configuration

The individual bar codes 50 can be arranged to read in two different directions, namely vertically and horizontally. This patent application applies to both reading directions.

(1) Vertical Bar Codes

When the bar code stripes are arranged vertically, the bar code scanning machine 60 will travel at the same speed as the vehicle and the laser reader must scan the bar code 50 horizontally within the available reading time of 6 to 8 milliseconds and the scanning speed would have to be close to the vehicle speed namely 12.5 m/sec to 16.67 m/sec. This is a high scanning speed by industry standards.

The vertical bar code stripes arrangement has the advantage that the vertical vehicle vibrations will not have any significant effect on the accuracy of the bar code reader 60 since the principal amplitude of the vibrations lies in the same direction as the bars.

(2) Horizontal Bar Codes

When the bar code stripes are arranged horizontally, the bar code scanning machine 60 will travel at the same speed as the vehicle, but the laser bar code reader can scan the bar code vertically at a much slower rate. The reading time available must still be 6 to 8 milliseconds, but the reading distance across the bar code need only be 20 mm to 30 mm depending on the bar code line thickness.

The laser scanner would actually travel diagonally across the bar code since the travel path would be the resultant of the vehicle 80 speed and the travel distance of the scanner 60. Allowing for vibration tolerance and suspension deflection the laser scanner's vertical travel distance may not exceed 30 mm to 40 mm.

The horizontal bar code stripes arrangement has the disadvantage that the vertical vibrations of the vehicle 80 will make it more difficult to read the bar code 50 unless the bar code scanner 60 can be adequately stabilized. The potential vibrations are a problem because their principal amplitude is transverse to the bar code stripes. It is proposed to mount the scanner 60 on a softly sprung linkage with damping in order to protect the mechanism and to limit the frequency and amplitude of the vibrations of the scanner.

Bar Code Mounting Location

The bar codes 50 should be placed on the guideway 10 in such a way that they can be read from either side of the vehicle 80.

This is essential since a vehicle entering a switch will move away from the bar code on the opposite side of the turnout.

The bar code strip 50 should be protected from dirt and debris therefore a location on the running surface level of the guideway 10 is impracticable.

A location on the sidewalls is good. Two alternative continuous vertical surfaces are available for locating the bar code.

(1) The linear motor reaction rail, on the aluminum reaction plate which is not in contact with the motor primary or the gap maintenance wheels. This rail is subject to continuous vibration and failure of a gap maintenance wheel may allow the electromagnetic switch or linear motor armature to scrape the reaction rail surface. Damage to the bar code must be absolutely avoided.

(2) The control and communication system ductway which has no contact with the vehicle at all. This is one of the preferred bar code surfaces since it can be isolated from vibration.

Bar Code Scanner Description

Commercial bar-code scanners with high raster scanning speed are suitable for the position recognition system. They must however be adapted or modified to meet the operating conditions of PRT which involve dynamic movement, vibrations, temperature extremes, exposure to electromagnetic fields, exposure to radio interference of various types and a requirement for high reliability which may be interpreted as a high Mean Time Between Failures (MTBF). Typically a MTBF of 10,000 hours will be required for each scanner 60.

Bar Code Scanning Distance

The bar-code scanning distance between the bar-codes 50 on the guideway communications duct 21 and the face of the scanner 60 will not exceed 200 mm and should not be less than 100 mm. The optimum distance will be determined by detailed field testing under real operating conditions. The optimum scanning distance will be determined by the width of the reading field, the line size of the bar code and the effects of vibration.

The bar code reader 60 is required to scan the bar code 50 adjacent to the chassis. As the vehicle enters a switch the distance between the opposite guideway wall and the chassis 40 will increase to 900 mm before the gore point of the switch is reached and dual guidewalls resume. The bar code on the opposite guidewall will increase in range as the vehicle 80 moves through the switch.

Auto Focus System

The situation arising when one scanner 60*a* has failed in service is not serious in the guideway 10 line sections since the scanner 60*b* on the opposite side can read the bar code 50*b*. When the vehicle 80 enters a switch section, however, the distance from the chassis 40 to the opposite guideway wall increases to about 900 mm before the single guideway 10 section resumes. It is required that a single scanner 60*b* can continue to read the bar code 50*b* on the opposite guideway wall in the event of failure of the scanner 60*a* on the turnout side. For this reason the scanners 60 must be equipped with automatic focus. The focal range should be from 100 mm to 1200 mm.

The autofocus must be able to read successive bar codes whose reading range is changing at 15 mm increase or decrease in 6 to 8 milliseconds.

Bar Code Reading Field

The bar code reading field for most high speed commercial scanners is related to the scanning distance and the bar code line width for the narrow bar. Typical distances of 100 mm to 200 mm will require bar thickness of 0.15 mm to 0.3 mm. The field width will be 100 mm to 200 mm typically. The scanner field angle is generally about 65 Degrees.

Electric Power Supply

The bar code scanner will be supplied with 12vDC power directly from the vehicle's batteries. These batteries are kept fully charged. The power supply will be duplicated and redundant.

Electric Power Consumption

Typical electric power consumption will be 4 Watt for each scanner.

Bar Code Scanner Light Source

Typically a visible laser diode will be used.

Maximum Resolution

The maximum resolution of the scanner will be 0.15 mm to 0.30 mm, however the PRT bar code will be substantially larger to minimize the effects of vibration and dirt on the reading accuracy. The maximum number of bar coded digits to be read will be six. These can be made thick enough to cover the width of the focal range.

Aperture Angle Of Bar Code Scanner

The typical aperture angle will be 65 degrees.

Raster Scanning

For the vertical bar code scanning configuration, the scanning path will be the resultant of the vehicle speed horizontally and the scanner reading speed vertically. Since the maximum vehicle speed will be 12.5 to 16.7 m/sec and a typical scanning speed will be 5.0 m/sec the raster scan tangent will be 0.4 to 0.3. However the vehicle speed will be variable therefore the raster scan tangent must be variable. The scanner 60 must be able to accomodate variable raster scan tangents in which the apparent line thickness will vary. Raster scanning is an essential element of the position recognition design.

Readable Codes

Most commercial bar code scanners 60 can be designed to read up to 15 code types. In the SKYCAR location system only one code is required. Most commercial scanners can discriminate up to 5 different codes, but in this application only one code is required.

Bar Code Reader Dimensions

Various scanners are available on the market. Typical suitable models are 101 mm×84 mm×66 mm.

Bar Code Reader Weight

Typical weight of the scanner unit 60 excluding mountings will be 0.70 Kg.

Case Material

The scanner 60 case will be designed for all weather operation and will protect the units from shock and penetration by foreign objects. Suitable case materials include cast aluminum, composites such as carbon fiber and strong polycarbonates. The casing must be provided with a shield to eliminate electromagnetic interference.

Operating Temperature

The bar code scanner 60 is designed to operate satisfactorily at temperatures within the range of 0 to +45 Degrees Celsius. A heating unit will be incorporated into the case for winter operation at temperatures below 0 Degrees Celsius. A ventilation fan will be fitted into the case to maintain temperatures below the upper limit of +45 Degrees.

Storage Temperature

The acceptable storage temperature limits are +70 to −20 Degrees Celsius. The vehicles 80 will normally be stored under cover and kept within these limits. Vehicles stored on the guideway outside the storage depot can be cooled or heated from the 12vDC emergency battery power source if necessary.

Humidity Limits

The humidity limits should be kept below 90% Non-Condensing.

Vibration Resistance

The bar code scanner 60 should be able to withstand, without damage or reduction in performance, vibrations equivalent to IEC 68-2-6 test FC 1.5 mm at 10 to 55 Hz, for two hours on each axis. Since this is a transit vehicle subject to thousands of hours of use a specially designed vibration-resistant scanner will be specified for commercial use.

The bar code scanner 60 will be mounted to the vehicle chassis 40 on soft isolation springs 66 equipped with dampers 66. These will be designed to isolate the scanner 60 from all but minor vibrations.

The guideway 10 will be subject to vibrations generated by successive live loads, vehicle 80 impact loads, wind loads, and possible accidental impacts. The guideway's natural vibration frequency will be 5 Hz. The amplitude of guideway deflection will be +/−30 mm.

The vehicle 80 will also be subject to vibrations generated by irregularities in the guideway 10 running surface, resonance with guideway vibrations, out-of-round wheels 41 & 42, propulsion reactions, wind loads and possibly, but very rarely collisions between vehicles.

The vehicle 80 will have a suspension system consisting of polyurethane wheels 41 & 42 mounted on elastomerically sprung mounting arms.

Shock Resistance

IEC 68-2-27 test EA 30 G, 11 ms, three shocks on each axis.

Protection Class

The protection class shall at least meet IP64

Sensitivity to EMI

The laser bar code reader 60 will be required to operate in close proximity to Electro-Magnetic Interference (EMI) sources including linear motors, electromagnets, and other AC and DC equipment.

The laser scanner 60 and its control equipment 70 should not be affected by such sources or should be capable of being completely shielded from such influences.

Sensitivity to EMF

The laser bar code reader 60 will be required to operate in close proximity to Electro-Magnetic Forces (EMF) of an intermittent and continuous nature. These will be generated by electromagnets, linear induction motors 44 and other types of electrical equipment including transformers, VVVF inverters 74 and rotary electric motors.

The laser scanner 60 and its control equipment 70 should not be affected by such forces or should be capable of being completely shielded from such influences.

Bar Code And Scanner Protection From Dirt And Dust

The bar code 50 itself must be kept clean at all times in order to avoid reading errors. The laser scanner 60 must also be kept clean at all times to avoid scanning errors.

The fact that the guideway 10 is covered and that the vehicle chassis 40 runs inside the guideway 10 is an essential element of this design. Without protection from weather and accumulations of dirt and debris, the bar code location concept would not be practical.

The Requirement For The Guideway Cover And Other Measures

In addition to the protection afforded by the guideway cover 13 the wheels of the vehicle 41 & 42 will be shielded so that they do not throw up any spray from the guideway 10 running surfaces. Two sources of spray are possible.

(1) Rainwater entering the guideway 10 where the sealing strip (18) is not perfectly tight. Blown snow is another source of moisture.

(2) Guideway lubricant thrown up by the wheels. The guideway lubricant is considered to be desirable for reasons of reducing wheel wear, rolling resistance etc. A light grease may be better than a liquid lubricant for this reason. The option of dispensing with the lubricant is also considered.

(3) Dust can be generated inside the guideway 10 from the friction between the power supply rails and the power collection shoes. This dust will consist of a carbon/graphite compound which is highly adhesive under electrical charge. In time this dust could obscure the bar codes 50 or at least cause the scanner 60 to misread them in places.

Protective Measures Against Spray and Dust

The vehicle support wheels will be fitted with covers to contain spray thrown up by the wheels when the guideway surface is wet. The guideway cover will keep out most moisture under open slot conditions and virtually all moisture under sealed slot operating conditions.

The lateral guidance wheels will also be fitted with a light weight cover where it is possible for them to generate spray from a wet guideway. The upper guidance wheels will be well protected from the entry of water by the guideway cover, and for this reason the bar code location is in the top part of the guideway.

Dust entering the guideway from the atmosphere will be a continuing problem which can best be handled by the use of seals on the guideway slot. Operating environments where high airborne dust levels are not a problem could operate during dry summer periods without the covers.

Dust generated by the contact between the power supply rails and the power collection shoes mounted on the vehicle is a serious problem which will be minimized by several methods.

Power rails will be aluminum with a stainless steel cover. Little or no wear will occur with this material and stainless steel particles are therefore not expected to be a problem since these will be removed by daily cleaning of the bar code.

Power collection shoes fitted with the traditional carbon/graphite compound used on the pantographs and collector shoes of subways are not suitable for this system due to the high levels of dust generated by shoe wear. This dust is black, and usually electrically charged which causes it to cling to any adjacent surface. If built up in sufficient quantity it can also form a short circuit conduction path.

The power collection shoes will be made of a copper alloy which combines high conductivity with good brushing properties to minimize wear while achieving reliable contact with the power rail. The shoes will be suspended on soft springs fitted with dampers to maintain contact with the power rail at all times.

Maintenance of Bar Code Location System for Guideway and Vehicles

The maintenance of this vehicle location system is of crucial importance for reliable and accurate vehicle control. The following maintenance procedure is part of the system design.

Guideway Cleaning

An automated guideway cleaning unit will be driven over the entire guideway at least once every day.

The cleaning unit can be operated during the service hours and will operate at the same speed as the passenger vehicles 80. The service unit will optically scan the bar codes 50 on each side of the guideway 10 and monitor the build up of dust or spray. Where necessary a cleanser spray and wiper will be applied automatically to clean the affected part.

A more thorough cleaning will be performed at the end of each operating day in which the entire bar code 50 will be gently cleaned at slow speed. A vacuum cleaning unit equipped with agitator brushes will be used to remove dust.

The scanners 60 will be cleaned and checked daily in the storage and maintenance depots. Each scanner 60 will be tested diagnostically and functionally. Lense covers will be cleaned each time the vehicle enters and leaves the depot. The VMS (Vehicle Maintenance System) will monitor scanner 60 performance on a daily basis to check for any deterioration in performance.

The Requirement For Redundancy

The design philosophy for PRT is to make all primary control and propulsion systems redundant. This means that the failure of any primary component will not cause a breakdown of the PRT system. The position recognition apparatus is a primary component and is therefore duplicated by having a scanner 60 on each side of the vehicle 80 and a barcode 50 on each side of the guideway 10. The mean time between failure of a redundant system is MTBF× MTBF which will be a very large number. The PRT vehicles 80 are programmed to return to the maintenance depot immediately any single primary component fails so that the chance of a second failure within the time required to reach the depot is very small indeed.

The Requirement For Failure Monitoring

The vehicles 80 will be equipped with a failure monitoring system which will check on the reliability of the vehicle location system.

The failure monitor will detect any failure to read a specific location. This could be due to a variety of causes:

(1) Dirt on the bar code 50 at a given location. (This is not necessarily serious if only one to five bar code sections (100 mm to 500 mm) are obscured, but affecting all vehicles).

(2). Dirt on the scanner 60 lens cover (Serious and considered a primary failure requiring programmed return of the vehicle to the depot).

(3) Failure of the scanner unit 60 or in the electronic processing unit of the scanner (Serious and requiring programmed return of the vehicle to the depot). The vehicle 80 would have to rely on the redundant scanner on its opposite side for determining location.

The Vehicle Control Circuit

This patent claim concerns the use of bar code readers 60 fitted to short headway vehicles 80 moving on a guideway 10 fitted with a bar code 50 in order to locate their position with a high degree of accuracy.

The bar code readings will be transmitted to a Computer Processing Unit 72 on-board the vehicle 80 where they will be used to calculate the vehicle's location on the guideway network, its speed and acceleration or deceleration rates. This data will be used to control the speed of the vehicle 80 according to control requirements. The data will be transmitted to the guideway zone controllers for each guideway 10 section, and the data will also be transmitted to adjacent vehicles 80 so that these can adjust their speed to each other.

The design of the control system 70 itself is not the subject of this claim, however the requirements of the control system 70 are described in order to explain the importance of accurate vehicle 80 location for a PRT system.

INDUSTRIAL APPLICABILITY

The present embodiment differs from the current industrial use of bar-code scanners in railways and other transportation systems such as conveyor lines where the bar-code is mounted on the moving vehicle or component, and the scanner is stationary mounted beside the track or conveyor line. In such industrial applications the bar-code scanners are used to identify the passing vehicles or components at a given fixed point, but are not used to calculate their location at any point in the transportation system or to calculate their speed.

The present embodiment of the position recognition apparatus enables the location of any PRT vehicle to be established precisely within an accuracy of 100 mm (+/−50 mm) and allows the speed to be calculated with an accuracy of +/−1% at any position on a large guideway network. The position and speed can be calculated every 6 to 8 milliseconds thereby providing a means of establishing accurate interval maintenance between vehicles and preventing in advance any collision between the vehicles.

What is claimed is:

1. A position recognition apparatus for a personal rapid transit, system including a vehicle guideway (10), for aerial-installation at railways in urban areas, and small vehicles (80) for traveling along the vehicle guideway (10) at a time interval of as short as 0.5 seconds between vehicles to provide respective small units of passengers with rapid transit, the guideway comprising two sides and further comprising control ducts attached to both said sides of the guideway, comprising:

position designation means, comprising bar code members (50*a* & 50*b*) comprising strips arranged in a continuous band configuration on which bar-codes (50) are printed by engravement, wherein said bar-code members (50*a* & 50*b*) are attached to the control ducts (21*a* & 21*b*) attached to both said sides of said guideway (10) to be displayed towards said vehicles (80), for designating sections and respective corresponding positions of said guideway (10) as at least one member of the group consisting of figures and letters, to designate passage positions where said vehicles (80) travel along said guideway (10);

control means (70);

position recognition means, comprising bar code scanners (60*a* and 60*b*) installed on said vehicles (80) to be opposite to said position designation means, for reading out and recognizing a current position of said vehicles (80) from bar codes of said position designation means, and transmitting recognized position signals of said vehicles (80) to said control means (70); and said control means (70), disposed adjacent to said position recognition means, for receiving the position signal supplied from said position recognition means of said vehicles (80), and controlling travelling speed of said vehicles (80) and time intervals between vehicles on the guideway (10).

2. The position recognition apparatus as claimed in claim 1, wherein said bar code members (50*a* and 50*b*) are attached so that bar codes are positioned in the vertical direction.

3. The position recognition apparatus as claimed in claim 1, wherein said bar code members (50*a* and 50*b*) are attached so that bar codes are positioned in the horizontal direction.

4. The position recognition apparatus as claimed in claim 1, wherein said position recognition means comprises laser scanners (60*a* and 60*b*) which are integrally fixed to a chassis (4) of said vehicles (80), for reading out the bar codes, wherein said scanners (60*a* and 60*b*) are disposed opposite to said bar code members (50*a* and 50*b*).

5. The position recognition apparatus as claimed in claim 2, wherein said position recognition means comprises first and second laser scanners (60*a* and 60*b*), a pair of support linkages (63*a* & 64*a*) functionally attached to the first scanner (60*a*) to support the first scanner (60*a*) and another pair of linkages (63*b* and 64*b*) functionally attached to the second scanner (60*b*) to support the second scanner (60*b*), the linkages are extended horizontally from the chassis (40) of said vehicles, and the linkages (63 & 64) are provided with shock absorbing spring/damper linkages (66*a* & 66*b*) respectively.

6. The position recognition apparatus as claimed in claim 1, said system comprising a propulsion/braking linear motor, said vehicle chassis (40) having electromagnetic switches for directing the vehicle to the right or left through a fork in the guideway, wherein said control means (70) comprises network boards (71*a* & 71*b*) connected electrically to said position recognition means and mounted on the vehicle chassis (40) of said vehicles (80) for transmitting a position recognition signal supplied from said position recognition means of said vehicles (80), and duplicate redundant Computation Processing Units (CPU) (72*a* & 72*b*) coupled electrically with said network boards (71*a* & 71*b*) and mounted to the vehicle chassis (40), respective VVVF inverters connected electrically to said CPU boards, respectively, said Computation Processing Units control the propulsion/braking linear motors by means of the VVVF inverters (74*a* & 74*b*) and the switches.

7. The position recognition apparatus as claimed in claim 1, wherein said guideway (10) further comprises a protective cover (13) and slot sealing strip (18) which prevent dust and debris from entering the guideway interior where they might interfere with the accurate scanning of the bar-codes (50*a* & 50*b*).

8. The position recognition apparatus as claimed in claim 7, wherein the guideway cover is insulated acoustically to minimize noise from the vehicle (80) running gear and electrical equipment, and it is insulated to block internally generated electromagnetic, microwave and radio waves from interfering with the operation of the position recognition means as well as other equipment.

9. The position recognition apparatus as claimed in claim 4, wherein the position recognition laser scanners (60*a* & 60*b*) are shielded from externally generated electromagnetic fields, microwave and radio transmissions by a case enclosing the apparatus.

10. The position recognition apparatus as claimed in claim 4, wherein the position recognition laser scanners (60*a* & 60*b*), respectively, have a case 60 and are insulated from temperature extremes by ventilation in summer and by an electrical heating pad inside the case in winter to maintain the laser scanners (60*a* & 60*b*) within specified operating temperatures and humidity limits.

11. The position recognition apparatus as claimed in claim 1, further comprising a guideway inspection vehicle for inspecting the bar-codes (50*a* & 50*b*) for cleanliness, and periodically cleaning the bar codes to ensure that the reading efficiency of the scanners (60*a* & 60*b*) is maintained.

12. The position recognition apparatus as claimed in claim 4, further comprising a maintenance/storage depot for inspecting the bar-code scanner units (60*a* & 60*b*) for cleanliness and correct functioning, and the depot comprising an automatic diagnostic and maintenance system to maintain the scanners (60*a* & 60*b*) in operation.

13. The position recognition apparatus as claimed in claim 4, wherein the bar-code scanner units (60*a* & 60*b*) are duplicated to operate redundantly and comprise failure monitoring means to immediately detect any malfunction in any individual scanner (60*a* & 60*b*).

14. The position recognition apparatus as claimed in claim 4, wherein the guideway comprises a switch section and the bar-code scanners (60*a* & 60*b*) are equipped with autofocus means for reading the bar-code (50) on the non-turn out side of the switch as the vehicle (80) passes through the switch section causing the focal distance to vary from 100 mm to 900 mm; and the bar-code scanners (60*a* & 60*b*) comprises means for raster scanning accurately for reading the bar-code (50*a* & 50*b*) at varying vehicle speeds with accompanying vehicle vibrations and with minor variations in scanning angle.

* * * * *